US006587051B2

(12) United States Patent
Takehara et al.

(10) Patent No.: US 6,587,051 B2
(45) Date of Patent: Jul. 1, 2003

(54) POWER CONVERTING APPARATUS AND BURGLARPROOF METHOD THEREFOR

(75) Inventors: Nobuyoshi Takehara, Kyoto (JP); Naoki Manabe, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,107

(22) Filed: Oct. 29, 2001

(65) Prior Publication Data

US 2002/0063625 A1 May 30, 2002

(30) Foreign Application Priority Data

Oct. 30, 2000 (JP) ..... 2000-331052

(51) Int. Cl.[7] ..... G08B 21/00

(52) U.S. Cl. ..... 340/635; 340/636; 340/687; 340/693.1; 340/693.3; 340/693.4; 307/64; 307/66; 307/117; 363/56.03; 323/299; 323/906

(58) Field of Search ..... 340/365, 568.1, 340/568.2, 568.3, 568.9, 333, 636, 600, 693.1, 693.2, 693.4, 691.5, 687, 693.3; 363/15, 13, 56.03, 71; 323/906, 299; 307/64, 66, 150, 151, 117

(56) References Cited

U.S. PATENT DOCUMENTS

| | | | | | |
|---|---|---|---|---|---|
| 5,892,354 | A | * | 4/1999 | Nagao et al. | 323/299 |
| 6,084,785 | A | * | 7/2000 | Kunisada et al. | 363/37 |
| 6,093,885 | A | | 7/2000 | Takehara et al. | 136/244 |
| 6,191,501 | B1 | * | 2/2001 | Bos | 307/64 |
| 6,252,785 | B1 | * | 6/2001 | Hagihara et al. | 363/71 |
| 6,320,769 | B2 | * | 11/2001 | Kurokami et al. | 363/56.03 |

* cited by examiner

*Primary Examiner*—Daniel J. Wu
*Assistant Examiner*—Davetta W. Goins
(74) *Attorney, Agent, or Firm*—Fitzpatrick, Cella, Harper & Scinto

(57) ABSTRACT

As the application range of solar power generation systems widens, a number of relatively compact and lightweight inverters must be installed outdoors. However, an inverter has no burglarproof function at all. A burglarproof device which switches the state of the burglarproof function upon receiving a burglarproof function state change signal, and outputs an alarm signal when the output signal output in the alarm state from a connection detection section indicates that the power supply or load is disconnected is added to the inverter.

11 Claims, 9 Drawing Sheets

POWER CONVERTING APPARATUS AND BURGLARPROOF METHOD THEREFOR

FIELD OF THE INVENTION

The present invention relates to a power converting apparatus and burglarproof method therefor and, more particularly, to a power converting apparatus for a power generation apparatus installed outdoors and a burglarproof method therefor.

BACKGROUND OF THE INVENTION

As the practical use of home solar power generation systems is making quick progress, many solar power generation systems are currently in operation. FIG. 1 is a block diagram showing the arrangement of such a solar power generation system.

DC power output from a solar battery 1 is input, through a blocking diode 4, to a system interconnection (to be referred to as "interconnection" hereinafter) power converting apparatus (to be referred to as an "inverter" hereinafter) 2 for supplying AC power to a commercial electric power system (to be referred to as a "system" hereinafter). The inverter 2 converts DC power to AC power and supplies it to a system 3 through a breaker S.

The inverter 2 has a primary-side capacitor 21 such as an electrolyte capacitor, a switching circuit 22, interconnection reactors 23, and a control section 24. The control section 24 has a function of controlling the entire inverter 2. The control section 24 generates a gate pulse signal to be supplied to the switching circuit 22 on the basis of signals obtained from a DC voltage detector 25, DC current detector 26, AC voltage detector 27, and AC current detector 28, thereby realizing DC/AC converting operation. In many cases, the control section 24 has a protective function of detecting an abnormality in system voltage on the basis of the detection signals and stopping the power converting operation of the inverter 2.

As the application range of solar power generation systems widens, a number of relatively compact and lightweight inverters must be installed outdoors. However, an inverter has no burglarproof means at all and therefore may be stolen. A solar power generation plant using a lot of inverters is probably operated assuming that the investment should be recovered by operating a solar power generation apparatus for a long time. If such a solar power generation plant suffers a burglary, not only the apparatus (asset) but also generated power is lost, and the investment recovery period considerably prolongs.

SUMMARY OF THE INVENTION

The present invention has been made to solve the above problems individually or altogether, and has as its object to prevent any burglary of a power converting apparatus.

In order to achieve the above object, according to a preferred aspect of the present invention, a power converting apparatus having a burglarproof function, comprising: a switch, arranged to switch an alarm state; a sensor, arranged to detect a connection state of a power supply and/or a load; and an alarm, arranged to give an alarm when the power supply and/or the load is disconnected in the alarm state is disclosed.

In addition, a burglarproof method for a power converting apparatus, comprising the steps of: setting an alarm state; detecting a connection state of a power supply and/or a load; and giving an alarm when the power supply and/or the load is disconnected in the alarm state is disclosed.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A solar power generation apparatus according to an embodiment of the present invention will be described below in detail with reference to the accompanying drawings.

Figure 1:
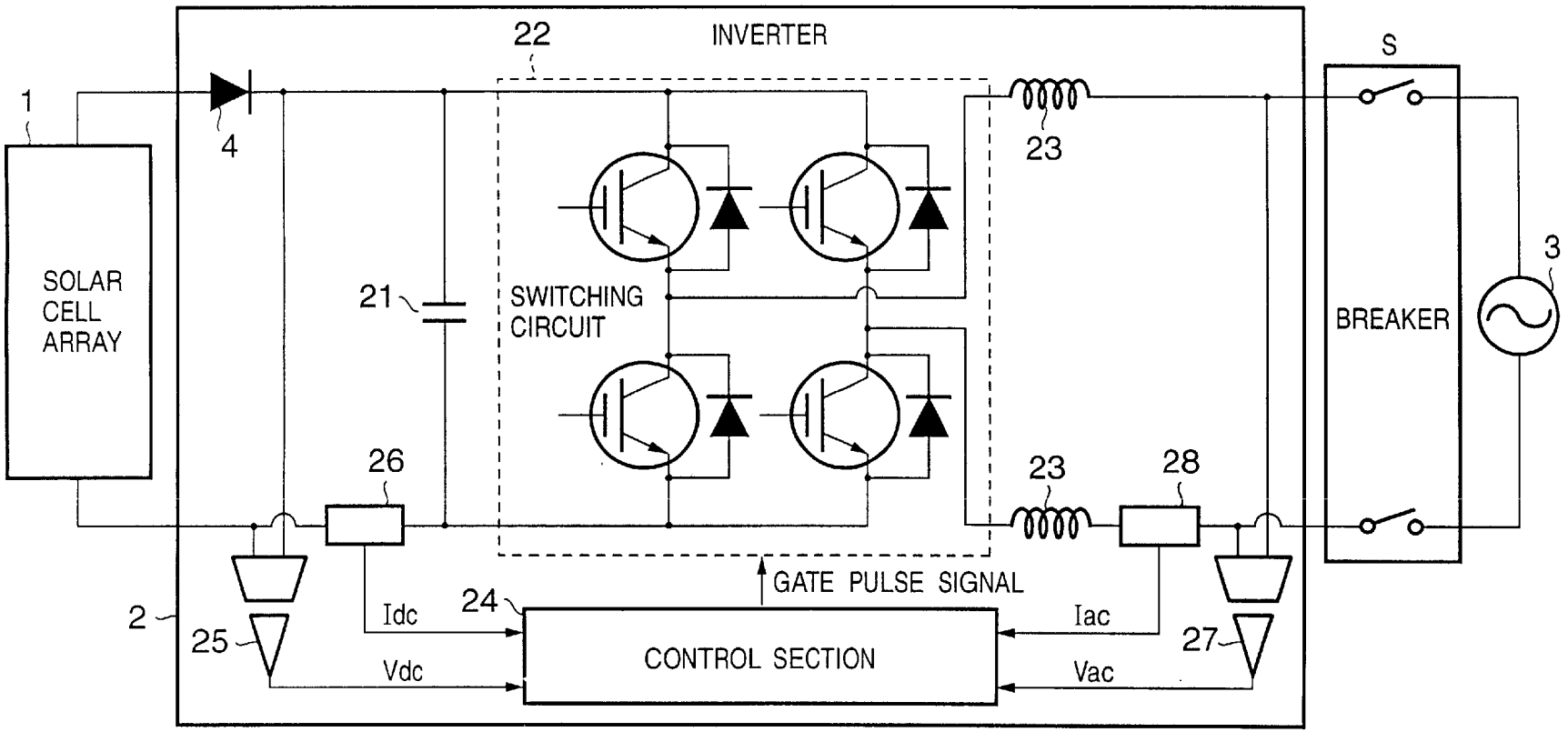
FIG. 1 is a block diagram showing the arrangement of a solar power generation system.
Figure 2:
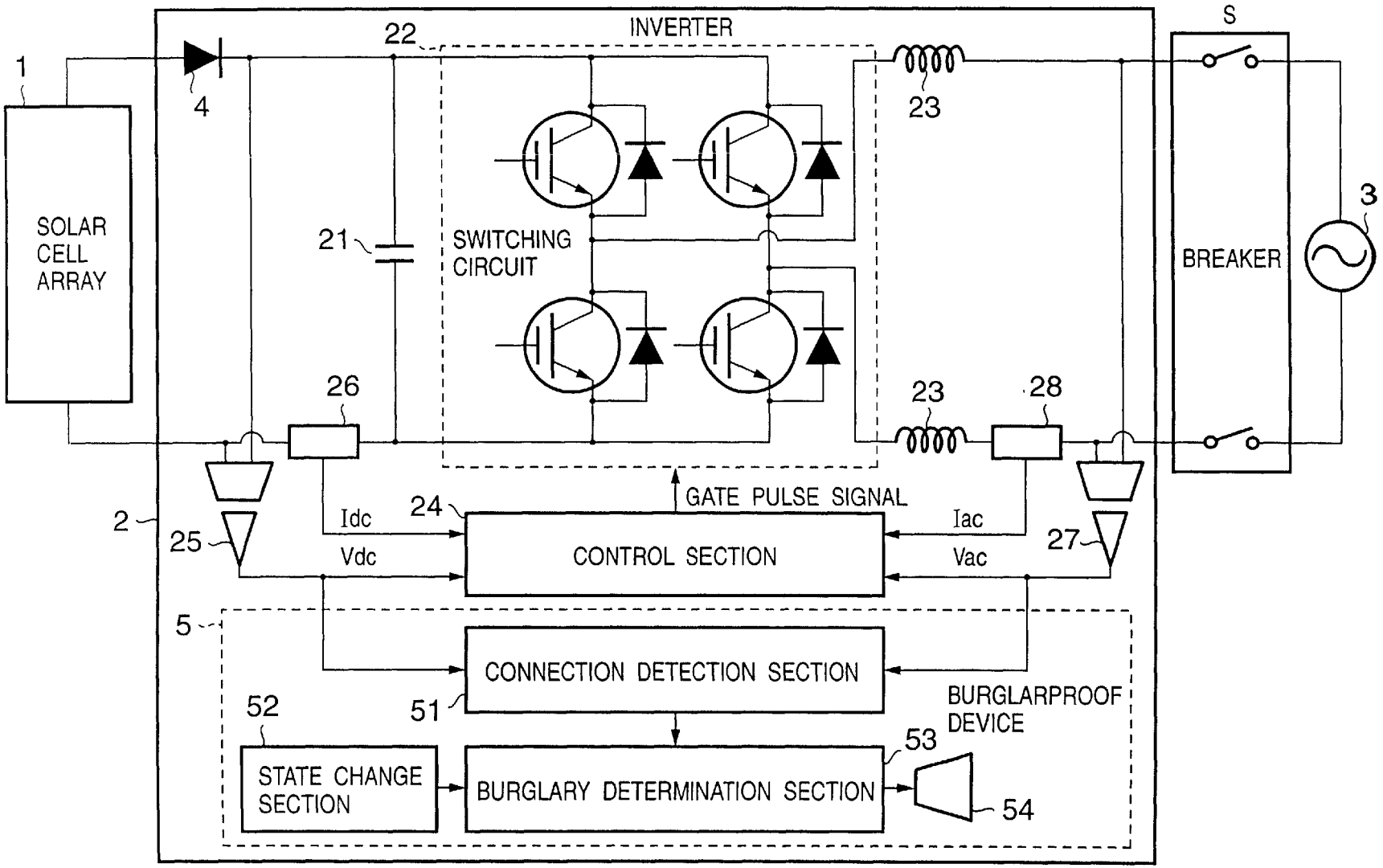
FIG. 2 is a block diagram showing the arrangement of a solar power generation apparatus having a power converting apparatus according to an embodiment.

FIG. 2 is a block diagram showing the arrangement of a solar power generation apparatus having a power converting apparatus according to this embodiment. The same reference numerals as in FIG. 1 denote the same parts in FIG. 2, and a detailed description thereof will be omitted.

A solar battery 1 is a solar cell array having an output of 3,060 W, which is formed by combining 60 (12 series×5 parallel) single-crystal solar cell modules each having nominal output power of 51 W.

An inverter 2 has a full-bridge switching circuit 22, and IGBTs are used as switching elements. As the switching elements, power transistors or MOSFETs may be used.

A control section 24 is formed from a one-chip microprocessor. Many techniques are known as the arrangement and operation method of the control system of the inverter 2, and a detailed description thereof will be omitted. Put simply, an output current instruction value is generated with reference to the voltage phase of a system 3 to change the amplitude of the output current in accordance with the output of the solar battery 1, thereby adjusting power to be supplied to the system 3.

As a DC voltage detector 25 and AC voltage detector 27, isolation amplifiers are used. The outputs from the DC voltage detector 25 and AC voltage detector 27 are supplied to the control section 24 and a burglarproof device 5 (to be described later).

The system 3 is a 200-V 60-Hz commercial AC system. In place of such a commercial AC system, a DC power supply system including a storage battery may be used. In this case, as the power converting apparatus, not an inverter but a DC/DC converter is used.

A breaker S disconnects the system 3 from the solar power generation apparatus. A so-called an EARTH-LEAKAGE circuit breaker is used as the breaker S.

The power converting apparatus (inverter 2 in FIG. 2) of this embodiment has the burglarproof device 5. The power converting apparatus need not always be an inverter and may be a DC/DC converter, and sometimes includes a charge/discharge control device for a storage battery. The power converting apparatus only need be electrically connected to at least one or both of the DC and AC sides.

The burglarproof device 5 comprises a power supply connection detection section 51 for detecting connection/disconnection between the power supply and the load, a state change section 52 for switching the operative/inoperative state of the burglarproof function, a burglary determination section 53 for determining a burglary, and an alarm section 54 for giving an alarm.

The connection detection section 51 detects the voltage on the power supply (solar battery 1) side or on the load (system 3 or secondary battery) side, thereby detecting connection/disconnection between the power supply and the load. The presence/absence of a current supplied from an external power supply may be detected, or a disconnection detection technique using a high-frequency power supply may be applied. Alternatively, the presence of an electrical wire connected to the connection terminal of the inverter 2 may be physically detected using, e.g., an optical sensor. That is, it is only necessary to detect whether power supply connection is maintained, and various means capable of providing such a function can be used.

The state change section 52 corresponds to a so-called key for switching the operative/inoperative state of the burglarproof function. Many known techniques for providing such a function can be applied to this embodiment. However, for the purpose of preventing burglary, any switch easily accessible from the outside of the device is not preferable. A switch whose location cannot be known from the outer appearance, and for example, a radio switch or a switch driven by a signal superposed on a power supply line is preferably used. It is also preferable to turn on/off the power supply by the operation signal for the state change section 52.

The burglary determination section 53 determines whether an attempt to steal the inverter 2 is being made on the basis of the state set by the state change section 52 and the detection result from the connection detection section 51. If such an attempt is being made, the burglary determination section 53 outputs an alarm signal to the alarm section 54. As the burglary determination section 53, an analog electronic circuit or digital electronic circuit can be used. A most preferable and versatile structure uses a one-chip microprocessor. A known burglarproof apparatus also most commonly uses such a form.

As the alarm section 54, a speaker capable of generating audio-band sound, a device for emitting light, or a device for generating a radio signal can be used. That is, the alarm section 54 only need to externally give an alarm at the time of burglary attempt. In, e.g., a solar power generation plant where a number of power converting apparatuses are installed in a wide area, it is practical to generate a radio signal. When an alarm is given by a radio signal, preferably, the radio signal indicating the burglary is received, and blinking lights arranged at appropriate positions in the solar power generation plant or the like are turned on, or a siren is sounded.

When the power supply or load is disconnected without any formal procedure, i.e., without causing the state change section 52 to turn off the burglarproof function, the burglarproof device 5 gives an alarm assuming that the power converter is about to be stolen. Hence, to continuously generate the alarm even after all the power supplies and loads are disconnected, a power supply for maintaining the operation of the burglarproof device 5 is necessary. Such a power supply is not indispensable and is optionally incorporated in the burglarproof device 5 as needed. As this power supply, a secondary battery represented by a nickel-cadmium battery or a primary battery such as a lithium battery can be used.

Detailed examples of the above embodiment will be described below.

FIRST EXAMPLE

As the first example, the arrangement of a burglarproof device 5 which changes the state of the burglarproof function by a radio signal will described.

A simple comparator is employed as a connection detection section 51 and set to output a signal indicating disconnection when both the DC and AC voltages have a predetermined value or less, e.g., 1 V or less.

As a state change section 52, a radio receiver is used and set to output a state change signal in accordance with the presence/absence of a radio wave near, e.g., 200 MHz. Many techniques are known for such a receiver. The use frequency is not particularly limited. Not the simple mechanism using the presence/absence of a radio wave but a more complex procedure may be employed to, cause the receiver to output a state change signal on the basis of a received code.

A one-chip microprocessor is used as a burglary determination section 53. The output signals from the connection detection section 51 and state change section 52 are supplied to the input ports of the burglary determination section 53. In addition, an alkali battery is used as a backup battery to make it possible to maintain alarm generation even when all power supply lines are disconnected. As an alarm section 54, a simple sound generation device (more specifically, a buzzer) is employed.

The operation of the burglarproof device 5 will be described next.

Upon receiving a predetermined radio wave, the state change section 52 sends a state change signal to the burglary determination section 53. Upon receiving the state change signal, the burglary determination section 53 changes the ON/OFF state of the burglarproof function. The description will be continued assuming that the burglarproof function is switched from the "cancel state" to the "alarm state". The burglary determination section 53 monitors the output signal from the connection detection section 51. If the output signal from the connection detection section 51 indicates disconnection, the burglary determination section 53 outputs an alarm signal to operate the alarm section 54.

Figure 3:
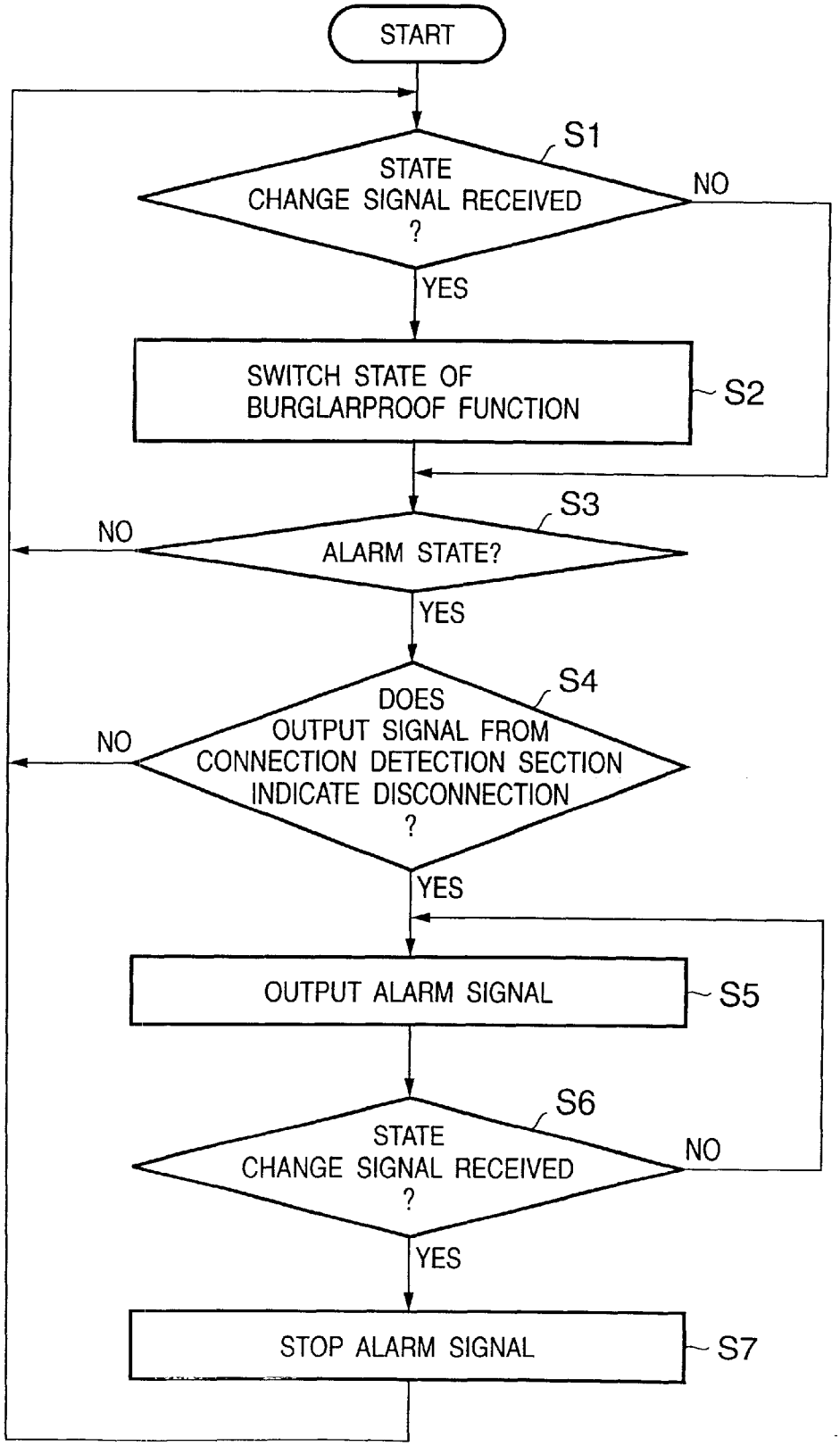
FIG. 3 is a flow chart showing the schematic operation of a burglary determination section of the first example.

FIG. 3 is a flow chart showing the schematic operation of the burglary determination section 53.

When a state change signal is received (S1), the state of the burglarproof function is switched (S2). In the alarm state (S3), when the output signal from the connection detection section 51 indicates disconnection (S4), an alarm signal is output (S5).

The alarm signal output state is maintained until a state change signal is received. That is, when the state change signal is received (S6), the alarm signal is stopped (S7), and the processing returns to step S1.

The burglarproof device 5 does nothing unless it is set in the alarm state. In the alarm state, the burglarproof device 5 monitors the connection states of the power supply and load on the basis of the voltages of the power supply and load, and if disconnection occurs, gives an alarm. Hence, if the power supply or load is disconnected in the alarm state, it is determined that disconnection is done to steal the power converting apparatus, and an alarm is generated.

SECOND EXAMPLE

As the second example, the arrangement of a burglarproof device 5 which changes the state of the burglarproof function by turning on/off the power supply will be described.

When a number of power converting apparatuses are commonly connected to a single system 3, a burglarproof function state change instruction can be sent to all the power converting apparatuses by turning on/off the AC-side power supply at a concentrating point where the output line of the power converting apparatuses concentrate.

Figure 4:
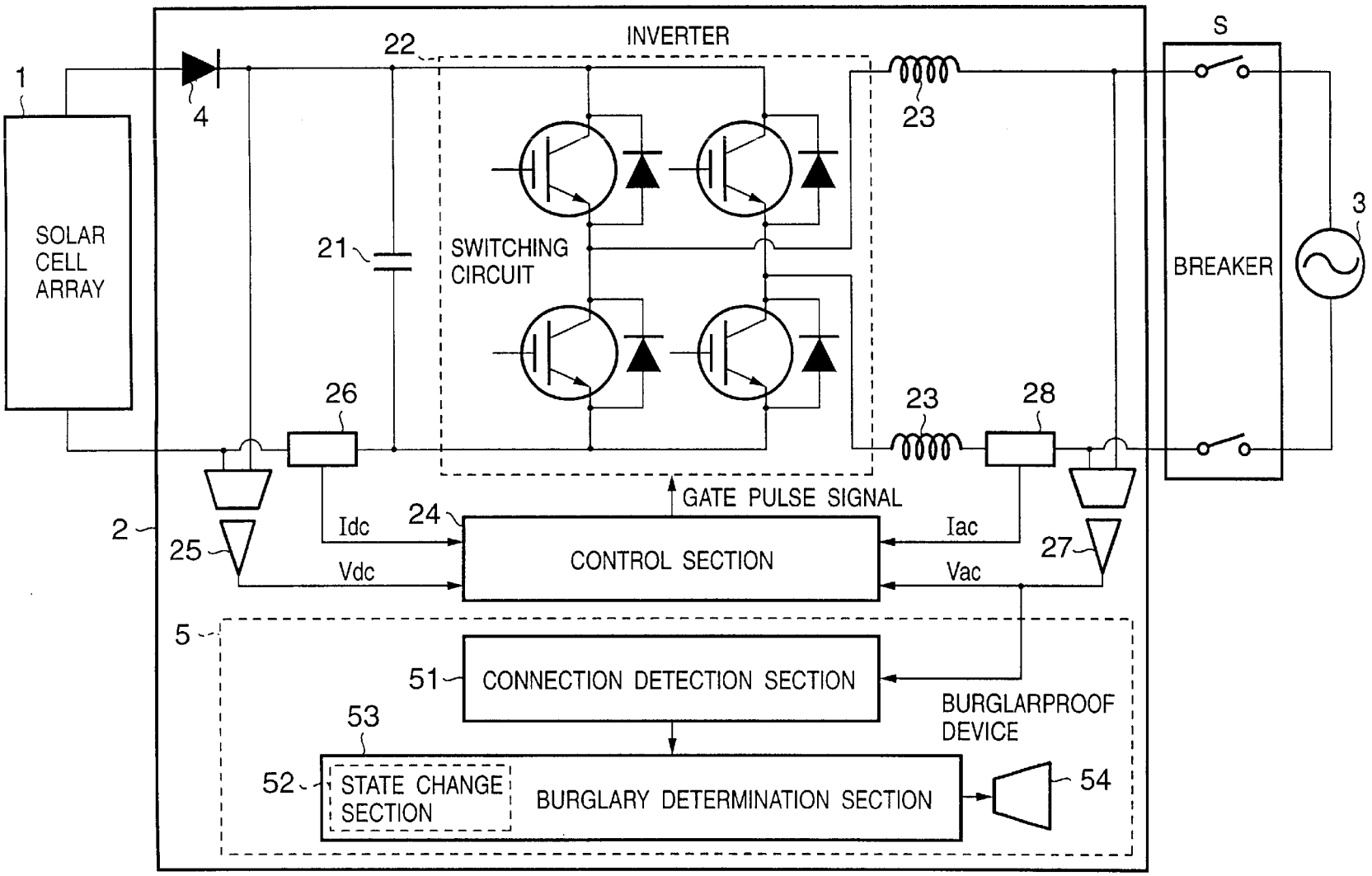
FIG. 4 is a block diagram for explaining the arrangement of a burglarproof device of the second example.

FIG. 4 is a block diagram for explaining the arrangement of the burglarproof device 5 of the second example. As in the first example, a connection detection section 51 outputs a signal indicating disconnection when the AC voltage on the load side decreases to, e.g., 1 V or less. The connection detection section 51 does not detect the voltage of a solar battery 1 (power supply side).

A state change section 52 is designed to output a state change signal by recognizing the ON/OFF pattern of the power supply. More specifically, the state change section 52 is incorporated in the burglarproof device 5 as one of programs to be executed by the one-chip microprocessor of a burglary determination section 53.

Figure 5:
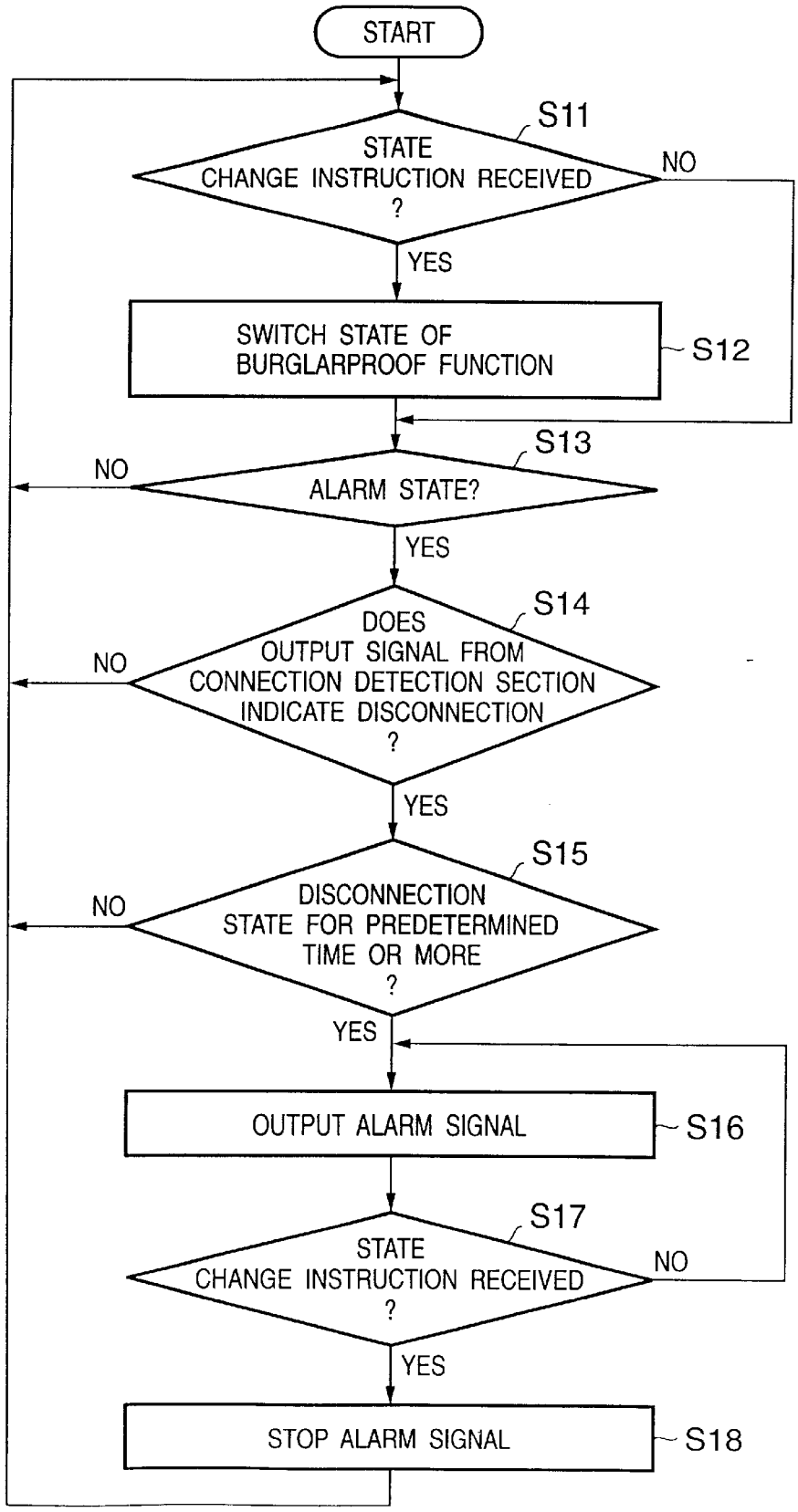
FIG. 5 is a flow chart showing the schematic operation of a burglary determination section of the second example.

FIG. 5 is a flow chart showing the schematic operation of the burglary determination section 53.

The burglary determination section 53 monitors the output signal from the connection detection section 51, upon recognizing a predetermined power supply ON/OFF pattern, determines that a state change signal is received (S11) and switches the state of the burglarproof function (S12). In the alarm state (S13), when the output signal from the connection detection section 51 indicates disconnection for a predetermined time or more (S14 and S15), an alarm signal is output (S16).

The alarm signal output state is maintained until a state change signal is received. That is, when the state change instruction is received (S17), the alarm signal is stopped (S18), and the processing returns to step S11.

The predetermined power supply ON/OFF pattern that indicates the state change instruction is stored in the ROM of the microprocessor or the like in advance, and has a condition, e.g., "three leading edges from power OFF to ON at an interval of about 2 sec". Such a periodical pattern that can hardly be observed at the time of power outage is normally set, though a more complex pattern may be used. A pattern that is not too redundant is appropriately selected as needed.

The processing of determining the duration of the disconnection state in step S15 is executed to discriminate between a burglary and unexpected power outage in determining connection/disconnection on the basis of the AC-side voltage. For preplanned power outage such as operation interruption, the alarm state is canceled. When the present frequency of power outage is taken into consideration, the power outage poses no serious problem in practical use. However, very short power outage (so-called instantaneous interruption) that relatively often occurs must be taken into consideration, and "disconnection" is determined when the disconnection state continues for, e.g., several sec (e.g., 2 sec) or more.

Figure 6:
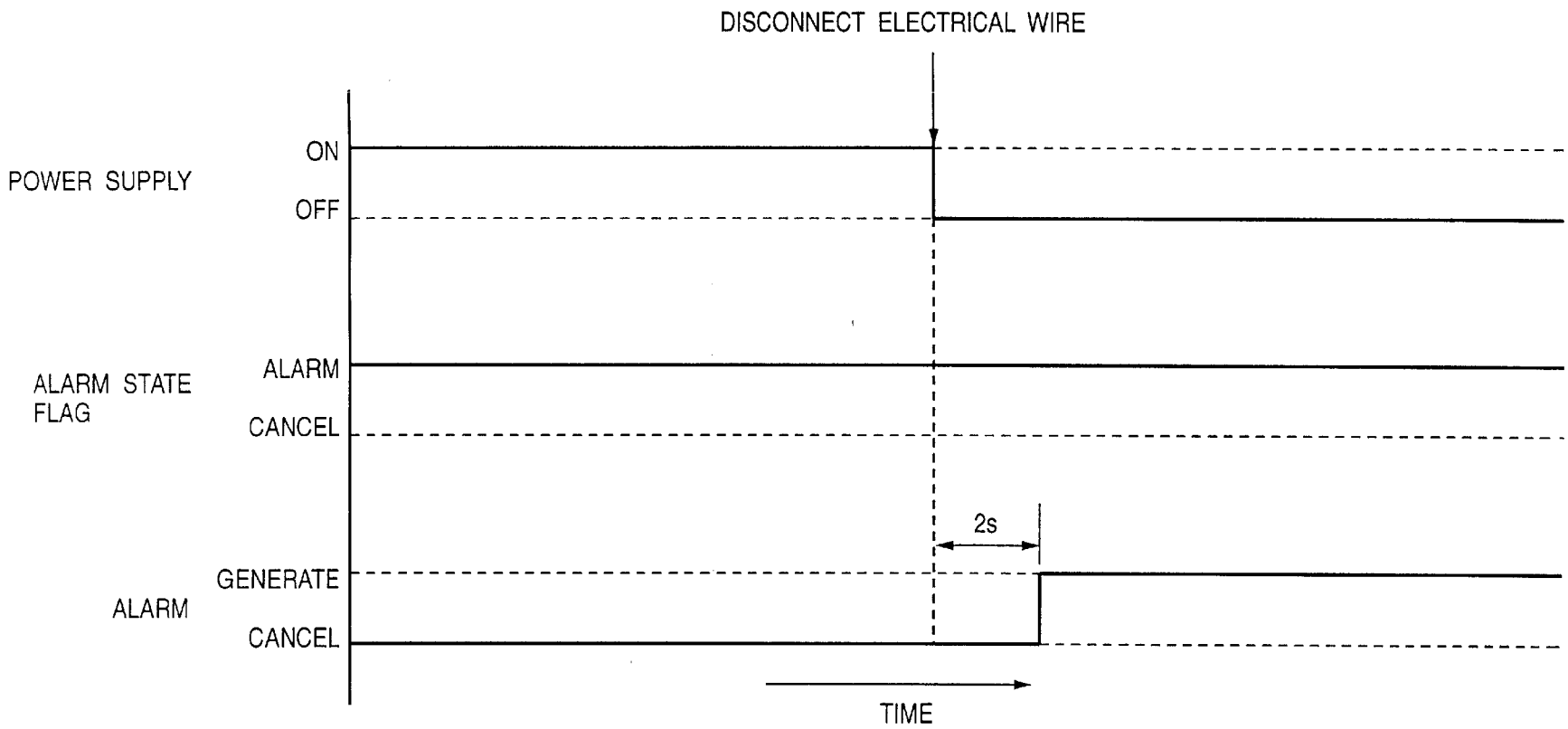
FIG. 6 is a timing chart showing alarm generation operation in the second example.

FIG. 6 is a timing chart showing alarm generation operation. When the alarm state flag is set in the alarm state, an alarm is generated about 2 sec after the AC-side electrical wire is disconnected.

Figure 7:
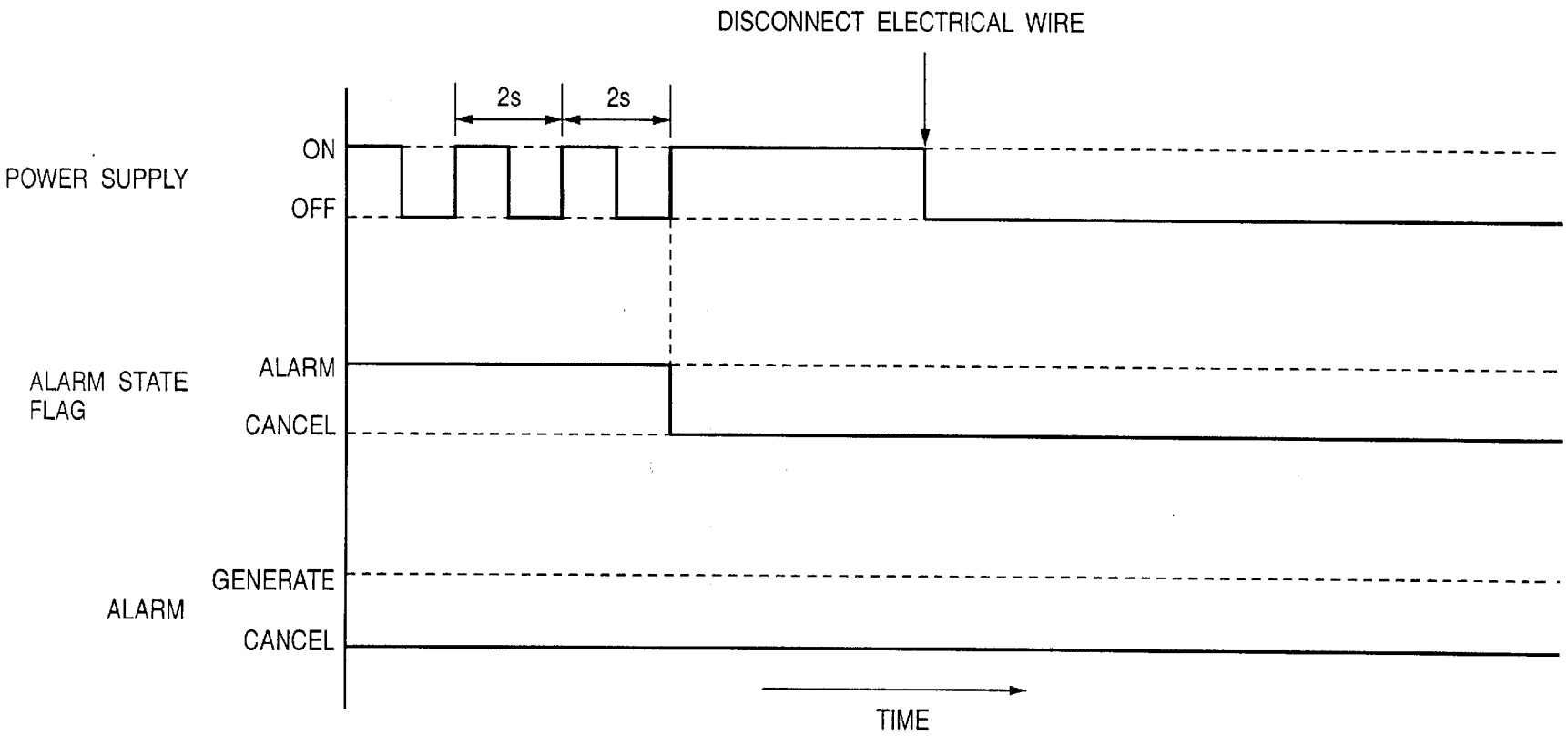
FIG. 7 is a timing chart showing alarm state cancel operation by a state change instruction in the second example.

FIG. 7 is a timing chart showing alarm state cancel operation by a state change instruction. When three leading edges from power OFF to ON are present at an interval of about 2 sec, the alarm state flag is inverted to cancel the alarm state. After that, even when the AC-side electrical wire is disconnected, no alarm is generated. When power ON/OFF with the same pattern is repeated again, the alarm state flag is inverted to set the alarm state.

In the above-described example, the AC-side voltage is used to determine the ON/OFF of the burglarproof function and load disconnection. However, the same processing as described above can be realized even using the DC-side voltage.

THIRD EXAMPLE

As the third example, the arrangement of a burglarproof device 5 which externally applies a voltage to a solar battery 1 and checks the presence/absence of the current to determine whether the power supply (solar battery 1) is disconnected will be described.

Figure 8:
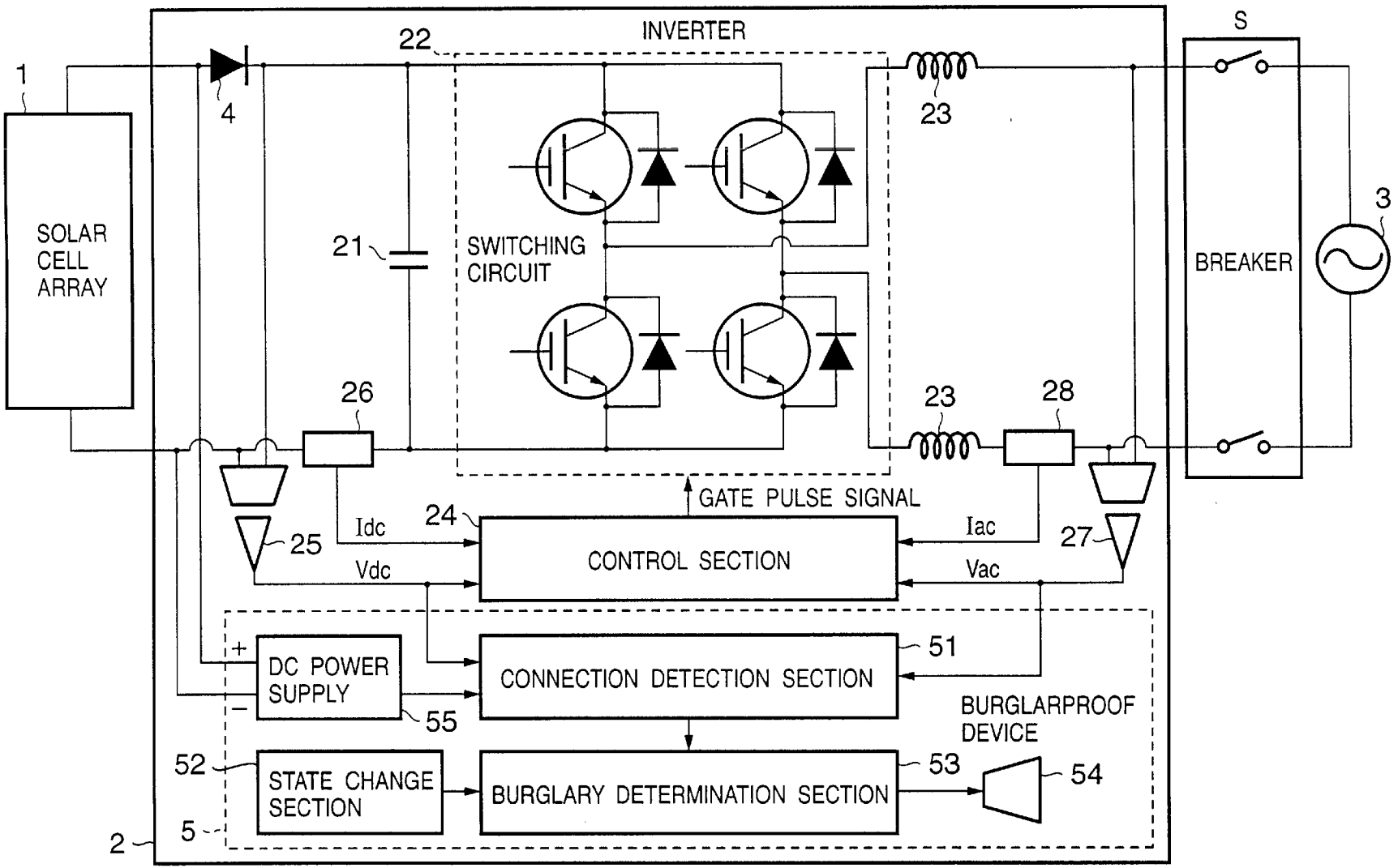
FIG. 8 is a block diagram for explaining the arrangement of a burglarproof device of the third example.

FIG. 8 is a block diagram for explaining the arrangement of the burglarproof device 5 of the third example. A connection detection section 51 outputs a signal indicating disconnection when the DC voltage decreases to, e.g., 1 V or less. The connection detection section 51 does not detect the voltage of a system 3 (load side).

The burglarproof device 5 of the third example has a DC power supply 55 for applying a voltage to the solar battery 1. The output voltage of the DC power supply 55 must be equal to or more than the open-circuit voltage of the solar battery 1. In this example, a 400-V, 0.1-A power supply is used as the DC power supply 55 in consideration of the open-circuit voltage of the solar battery 1. Unlike a snow-melting system, the DC power supply 55 can have a relatively small current capacity because it only checks whether the solar battery 1 and inverter 2 are connected.

Figure 9:
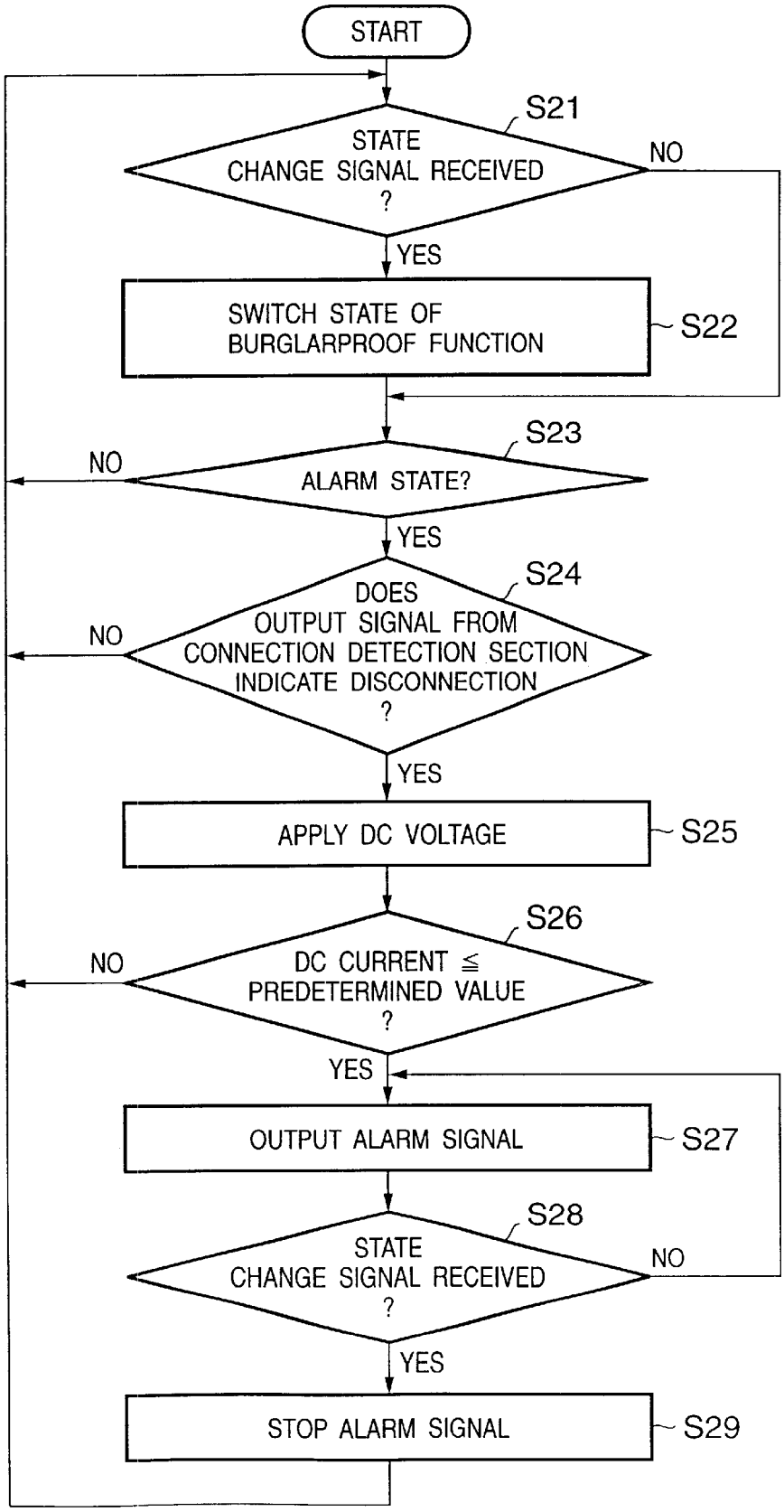
FIG. 9 is a flow chart showing the schematic operation of a burglary determination section of the third example.

A burglary determination section 53 determines a burglary upon receiving the output signal from the connection detection section 51 and the current signal from the DC power supply 55, and outputs an alarm signal. FIG. 9 is a flow chart showing the schematic operation of the burglary determination section 53.

Upon receiving a state change signal (S21), the state of the burglarproof function is switched (S22). In the alarm state (S23), when the output signal from the connection detection section 51 indicates disconnection (S24), a voltage is applied from the DC power supply 55 to the solar battery 1 (S25). If the current output from the DC power supply 55 has a predetermined value or less (S26), an alarm signal is output (S27).

The alarm signal output state is maintained until a state change signal is received. That is, when the state change signal is received (S28), the alarm signal is stopped (S29), and the processing returns to step S21.

According to the third example, first, the output voltage of the solar battery 1 is checked, and then, the output current of the DC power supply 55 is checked, thereby determining disconnection of the power supply. With this arrangement, when the solar battery 1 is generating power in the daytime, check can be performed using the output voltage of the solar battery 1. When the solar battery 1 generates no power at nighttime, check can be performed using the output current of the DC power supply 55. Hence, even at nighttime, the connection state of the power supply can be checked without being affected by power outage or instantaneous interruption of the system 3.

Normally, the DC power supply 55 need not apply a voltage because power generation by the solar battery 1 does not stop as long as the solar battery 1 is irradiated with sunlight. At night, since the solar battery 1 outputs no voltage, the connection state of the power supply is determined by applying a voltage from the DC power supply 55. That is, the connection state can be determined in consideration of the characteristic of the solar battery 1, and additionally, an alarm can be given not only against a burglary of the inverter 2 but also against a burglary of the solar battery 1.

As described above, according to the embodiment, any burglary of the power converting apparatus of a solar power generation apparatus can be prevented by adding a simple burglarproof apparatus to the power converting apparatus.

Especially, when the power supply ON/OFF pattern is used as a burglarproof function state change instruction, a terminal for receiving an external state change signal or a state change signal transmitter can be omitted, and hence, a very simple arrangement can be implemented.

When the connection state is determined by applying a voltage to the solar battery, any burglary of not only the power converting apparatus but also the solar battery can be prevented.

As many apparently widely different embodiments of the present invention can be made without departing from the spirit and scope thereof, it is to be understood that the invention is not limited to the specific embodiments thereof except as defined in the appended claims.

What is claimed is:

1. A power converting apparatus having a burglarproof function, comprising:

a switch, arranged to switch between alarm and non-alarm modes;

a sensor, arranged to detect whether or not a power supply and a power converter are electrically connected, and/or to detect whether or not the power converter and a load are electrically connected; and an alarm, arranged to give an alarm when disconnection between the power supply and the power converter is detected, and/or disconnection between the power converter and the load is detected by said sensor in the alarm mode.

2. The apparatus according to claim 1, wherein the power supply is a DC power supply, and the load is a storage battery or a commercial electric power system.

3. The apparatus according to claim 2, wherein the DC power supply is a solar battery.

4. The apparatus according to claim 1, wherein said sensor detects the connection between the power supply and the power converter on the basis of a current that flows when a voltage is applied from a check power supply to the power supply.

5. The apparatus according to claim 1, wherein said switch switches the alarm and non-alarm modes upon recognizing that a change pattern of a voltage of the power supply or load is a predetermined pattern.

6. The apparatus according to claim 1, wherein said switch switches the alarm and non-alarm modes on the basis of externally input light, sound, electricity, or radio wave signal having a predetermined change pattern.

7. A burglarproof method for a power converting apparatus, comprising the steps of:

setting an alarm mode or a non-alarm mode;

detecting whether or not a power supply and a power converter are electrically connected, and/or whether or not the power converter and a load are electrically connected; and giving an alarm when disconnection between the power supply and the power converter is detected, and/or disconnection between the power converter and the load is detected, in the detecting step and in the alarm mode.

8. The method according to claim 7, wherein the connection between the power supply and the power converter is detected on the basis of a current that flows when a voltage is applied from a check power supply to the power supply.

9. The method according to claim 7, wherein the alarm or non-alarm mode is set on the basis of a recognition result of a change pattern of a voltage of the power supply or load.

10. The method according to claim 7, wherein the alarm or non-alarm mode is set on the basis of externally input light, sound, electricity, or radio wave signal having a predetermined change pattern.

11. A computer program product stored in a computer readable medium comprising a computer program code, for preventing a burglary of a power converting apparatus, comprising process procedure code for:

setting an alarm mode or a non-alarm mode;

detecting whether or not a power supply and a power converter are electrically connected, and/or whether or not the power converter and a load are electrically connected; and giving an alarm when disconnection between the power supply and the power converter is detected, and/or disconnection between the power converter and the load is detected, in the detecting process and in the alarm mode.

* * * * *